United States Patent [19]

Ruf

[11] 4,167,940

[45] Sep. 18, 1979

[54] ROLLER TYPE MASSAGING APPARATUS FOR THE FEET

[75] Inventor: Robert Ruf, Safenwil, Switzerland

[73] Assignee: Ruf Handels AG, Safenwil, Switzerland

[21] Appl. No.: 821,714

[22] Filed: Aug. 4, 1977

[30] Foreign Application Priority Data

Jan. 19, 1977 [CH] Switzerland ..... 632/77

[51] Int. Cl.[2] ..... A61H 15/00

[52] U.S. Cl. ..... 128/57; 128/25 B

[58] Field of Search ..... 128/57, 25 B, 24.3, 128/69, 67

[56] References Cited

U.S. PATENT DOCUMENTS

| | | | |
|---|---|---|---|
| D. 101,862 | 11/1936 | Fehn et al. | 128/25 B |
| D. 152,951 | 3/1949 | Eldredge | 128/25 B |
| 2,079,311 | 5/1937 | Blumenthal | 128/25 B |
| 2,080,208 | 5/1937 | Illch | 128/57 |
| 2,400,023 | 5/1946 | Potter | 128/25 B |
| 2,546,095 | 3/1951 | Gustlin | 128/25 B |
| 2,735,434 | 2/1956 | DeRossett | 128/25 B |
| 3,415,514 | 12/1968 | Weihs | 128/25 B |

*Primary Examiner*—Lawrence W. Trapp

*Attorney, Agent, or Firm*—Ostrolenk, Faber, Gerb & Soffen

[57] ABSTRACT

A series of rollers held in a frame and covered with a textured, granular surface, simulating natural granular terrain.

6 Claims, 1 Drawing Figure

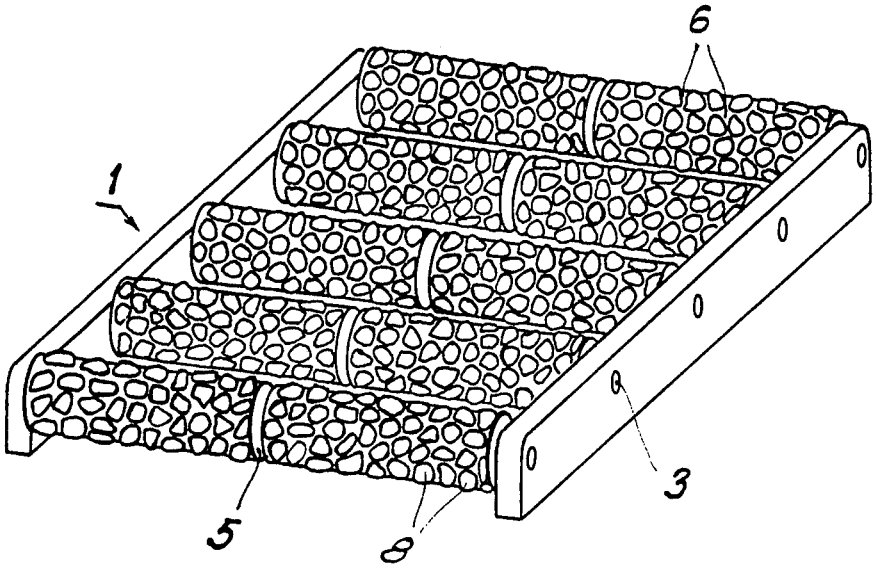
6
1
3
5
8

ROLLER TYPE MASSAGING APPARATUS FOR THE FEET

BACKGROUND OF THE INVENTION

Experts advocate walking with bare feet on a granular, pebble-like, or chip-type surface for purposes of massage and foot training. Examples of this are sand or pebble beaches. But, of course, not everyone has ready access to such terrain or surfaces.

SUMMARY OF THE INVENTION

The object of the invention is to enable anyone to walk on a granular, or pebble-like, or chip-type surface, not only at particular places, e.g., on lake fronts or sea beaches, but almost anywhere.

The invention comprises a plurality of rollers which are at least partly covered by a granular, pebble-like or chip-type surface and which rollers are held in a supporting frame.

BRIEF DESCRIPTION OF THE DRAWING

The invention is described more fully in connection with the drawing, which shows a perspective view of a foot massager.

DESCRIPTION OF A PREFERRED EMBODIMENT

The apparatus of the invention comprises two wooden side frames 1. Parallel metal bars 3 are inserted into the side frames at regularly spaced intervals along the length of the frames. All bars are at the same height on their side frames 1. On each fixed bar 3, there are arranged at least one, and preferably a plurality, of rotatable, cylindrically shaped rollers. To the outer surfaces of these rollers is applied a cement layer in which gravel pieces 8 are embedded. The gravel is comprised of relatively fine, but natural terrain simulating particles.

It is preferred that the rollers be comprised of wood. But it is possible to substitute any other roller material, e.g., plastic, for the wooden rollers. Instead of a fine gravel serving as the granular surface material, sand or stone chips can also be pasted or cemented onto the outer surfaces of the rollers 5. It is also possible to use a synthetic granular product, instead of a natural product. Furthermore, the outer roller surfaces, with their granular coatings, can be formed as a sheet layer apart from the rollers and can be applied later to the outer roller surfaces. Furthermore, the outer surfaces of the rollers can be initially molded in an appropriate granular texture foam, or the rollers themselves can be molded or cast to have such a textured exterior. As appropriate, the rollers can also be integrated with their outer covers, and the entire roller and cover assembly may be made of a plastic material.

The foregoing type of roller-type foot massager gives the feet which move over the rollers a feeling like one gets from walking on lake fronts or beaches covered with sand, pebbles or stones. A special massaging effect is achieved, which is not possible with foot massages having smooth surfaces, and particularly those having smooth rotatable surfaces.

An effective massaging surface with a cover of a granular, pebble or chip-type structure can be used in other types of massagers, such as treading mats.

Although there has been described a preferred embodiment of this novel invention, many variations and modifications will now be apparent to those skilled in the art. This invention, therefore, is to be limited not by the specific disclosure herein, but only by the appended claims.

I claim:

1. A roller-type massaging apparatus for the feet comprising, a plurality of rotatable rollers arranged in a parallel array and a frame supporting said rollers in that said array for rotation; said rollers having exterior surfaces which are textured granular surfaces.

2. The roller-type massaging apparatus of claim 1, wherein said textured granular surfaces are comprised of material to simulate natural granular like terrain.

3. The roller-type massaging apparatus of claim 1, wherein said roller exterior surfaces have natural materials attached thereto which are selected from the group consisting of sand, gravel, and stone chips.

4. The roller-type massaging apparatus of claim 1, wherein said rollers are covered on their respective said exterior surface with respective covers to which said textured granular surfaces are secured.

5. The roller-type massaging apparatus of claim 4, wherein the said textured surface is cemented to the roller.

6. The roller-type massaging apparatus of claim 1, wherein said textured granular surfaces are comprised of a synthetic plastic product.

* * * * *